United States Patent [19]

Kummerhoff

[11] Patent Number: 5,007,273

[45] Date of Patent: Apr. 16, 1991

[54] FOUR-HIGH ROLL OR SIX-HIGH ROLL STAND HAVING LATERALLY SUPPORTED WORKING ROLLS

[75] Inventor: Gerhard Kummerhoff, Hemer, Fed. Rep. of Germany

[73] Assignee: Sundwiger Eisenhütte Maschinenfabrik Grah & Co., Hemer-Sundwig, Fed. Rep. of Germany

[21] Appl. No.: 556,901

[22] Filed: Jul. 23, 1990

[30] Foreign Application Priority Data

Aug. 1, 1989 [DE] Fed. Rep. of Germany ..... 3925408

[51] Int. Cl.[5] ..... B21B 13/14

[52] U.S. Cl. ..... 72/242.2; 72/243.2; 72/243.4

[58] Field of Search ..... 72/241.2, 241.4, 241.6, 72/241.8, 242.2, 242.4, 243.2, 243.4, 243.6, 245, 247

[56] References Cited

U.S. PATENT DOCUMENTS 4,197,731 4/1980 Verbickas et al. ..... 72/243.4
4,270,377 6/1981 Verbickas et al. ..... 72/247
4,531,394 7/1985 Turley et al. ..... 72/238
4,918,965 4/1990 Kobayashi et al. ..... 72/243.2

*Primary Examiner*—Lowell A. Larson
*Assistant Examiner*—T. C. Schoeffert
*Attorney, Agent, or Firm*—Marmorek, Guttman & Rubenstein

[57] ABSTRACT

In a multi-roll stand having laterally supported working rolls 4, each working roll 4 is supported at at least one side against a radially unmounted lateral intermediate roll 5, which, for its part, is supported against a first, radially mounted supporting roller 6 and a further, radially unmounted intermediate roll 7. The further intermediate roll 7 is supported against a second, radially supported supporting roller 8 and against that intermediate roll 3 of a six-high roll stand which supports the working roll 4 vertically or against the supporting roll of a four-high roll stand. By virtue of this type of lateral support, the risk of slip between the working roll 4 and the lateral intermediate roll 5 supporting it is reduced because a torque is transmitted to the intermediate roll 5 from the intermediate roll 3 or supporting roll of the roll stand via the further lateral intermediate roll 7. In addition, the space for the lateral support can be better utilized for an increase in the supporting forces.

1 Claim, 1 Drawing Sheet

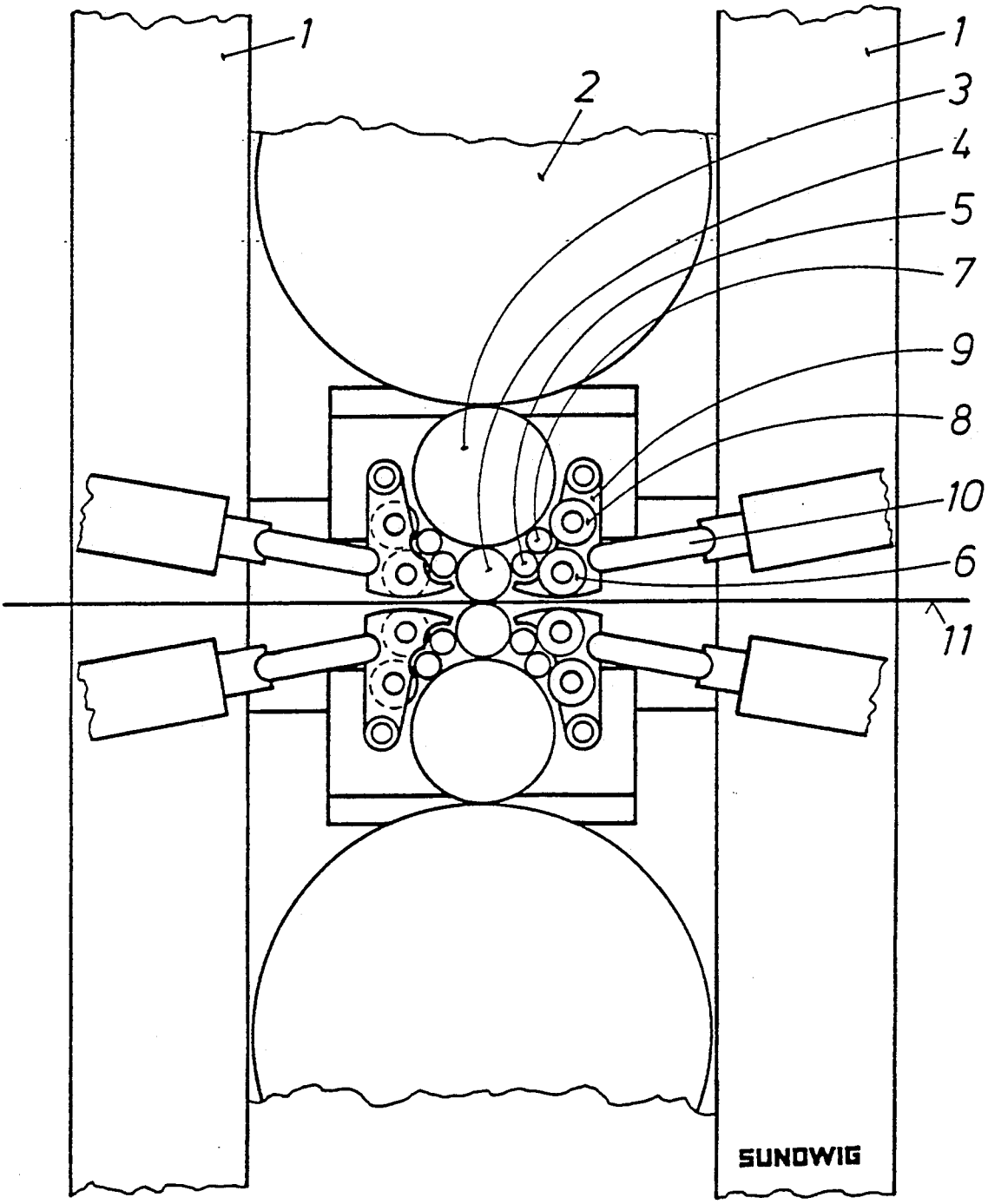
1
1
2
3
4
5
7
9
8
10
6
11
SUNOWIG

FOUR-HIGH ROLL OR SIX-HIGH ROLL STAND HAVING LATERALLY SUPPORTED WORKING ROLLS

The invention relates to a four-high roll or six-high roll stand having laterally supported working rolls, each support having a radially unmounted lateral intermediate roll resting against an associated working roll, and two radially mounted supporting rollers.

In the case of roll stands of this kind, the working rolls, the supporting rolls and, if required, the intermediate rolls, are either arranged in a common vertical plane, supports then being provided on both sides of the working rolls, or the working rolls and, if required, the intermediate rolls are laterally offset relative to the vertical plane defined by the axes of the supporting rolls, unilateral support of the working rolls and, if required, of the intermediate rolls then being sufficient. The reason for the use of the supports is to avoid uncontrolled horizontal bending of the working rolls. In particular, the lateral support is necessary in the case of working rolls where the ratio between the diameter of the working roll and its useful length exceeds 1:4. However, it is also possible, using the supports, to bend the working rolls in controlled fashion in order to influence the strip cross-section to be rolled.

In general, the supports each comprise a relatively thick lateral intermediate roll, resting against the associated working roll, and two radially mounted supporting rollers, against which the radially unmounted lateral intermediate roll is supported (British Patent No. 1,488,796; British Patent No. 1,329,971). The supporting rollers can each comprise a continuous roller or shorter rollers arranged in a row. The reason for the design of the support in the form of a relatively thick lateral intermediate roll and two supporting rolls supporting the latter consists in the fact that the space in which this support is to be accommodated is restricted, particularly when the ratio between the diameter of the working roll and the vertically adjacent intermediate or supporting roll is small, for example only 1:3. In this case, a wedge-shaped space is formed which is bounded, on the one hand, by the strip to be rolled and, on the other hand, by the shells of the working roll and intermediate roll or supporting roll. Under these conditions, the requisite lateral supporting forces can only be produced by using relatively thick lateral intermediate rolls because only then is sufficient space available to accommodate supporting rollers of correspondingly large dimensions which can absorb the supporting forces required. However, lateral supports having relatively thick lateral intermediate rolls with a correspondingly large mass moment of inertia have an unfavourable effect, since the transmission of the rotary movement starts from the working roll and slip may therefore occur between the rolls in the acceleration phase. This may result in surface damage, which is transferred to the rolled material.

Moreover, in the case of large lateral forces, the wedge-shaped space for accommodating the lateral support may be too small because of the requirement for relatively large dimensions of the supporting rollers.

The object on which the invention is based is, in a multi-roll stand, to improve the lateral supports of the working rolls in such a way that the supporting ability of the support is improved and the risk of slip between the rotating parts of the lateral intermediate roll is reduced.

This object is achieved according to the invention, in the multi-roll stand of the type stated at the outset, by the fact that the support has a further lateral intermediate roll and that a lateral intermediate roll is supported against one of the two supporting rollers and the further lateral intermediate roll, which is supported against the other supporting roller and, in the case of a four-high roll stand, against the supporting roll of the latter and, in the case of a six-high roll stand, against the intermediate roll of the latter.

Due to the use of the further lateral intermediate roll and its special support, it is achieved that, with a relatively small diameter of the intermediate rolls, sufficient free space remains for accommodating supporting rollers of correspondingly large dimensions, the supporting rollers being driven specially via the respective intermediate roll. The functioning and supporting ability of the support is thereby improved. The risk of slip between the working roll and the lateral intermediate roll resting directly against it is reduced because, on the one hand, the intermediate roll has a lower mass moment of inertia and, on the other hand, an additional torque is transmitted to the intermediate roll via the further intermediate roll from the supporting roll or intermediate roll of the roll stand. Finally, a lateral support is also obtained for that roll of the roll stand which directly supports the working roll. This is advantageous particularly in a six-high roll stand, in which the intermediate roll has a relatively small diameter.

The invention is explained in greater detail below with reference to a drawing representing schematically an illustrative embodiment.

Mounted in a roll housing 1 of a six-high roll stand are two supporting rolls 2, two intermediate rolls 3 and two working rolls 4. Associated with each working roll 4 on each side is a lateral support.

Each support has two supporting rollers 6, 8, each of which can comprise a continuous roller or roller sections. The two supporting rollers 6, 8 are mounted radially in a supporting-roller suspension 9. The supporting-roller suspension 9 can be adjusted towards the working roll by means of an adjustable supporting element 10.

Each support furthermore has two lateral intermediate rolls, 5, 7, which are considerably smaller in diameter than the working roll 4 and the supporting rollers 6, 8. These intermediate rolls 5, 7 are radially unmounted. The first lateral intermediate roll 5 supports the working roll 4 laterally. For its part, it is supported against the first supporting roller 6 and against the second lateral intermediate roll 7. The second lateral intermediate roll 7, for its part, is supported against the second intermediate roller 8 and against the adjacent intermediate roll 3 of the roll stand.

In this embodiment, it is possible, despite the restrictive conditions in the space bounded in the form of a wedge by the strip 11 to be rolled and the rolls 3, 4 of the roll stand to provide effective support for the first lateral intermediate roll which supports the intermediate roll 4 because the first lateral intermediate roll 5 is supported, on the one hand, against the first supporting roller 6, which has relatively large dimensions, and, on the other hand, against the second lateral intermediate roll 7, which has a small diameter but is supported, for its part, against the second supporting roll 8, which has relatively large support, and the intermediate roll 3 of the roll stand. In addition to this advantage, it is furthermore achieved with the construction according to the invention that a torque is transmitted to the first lateral intermediate roll 5 from the intermediate roll 3 of the roll stand via the second lateral intermediate roll 7, with the result that a torque is no longer transmitted to this intermediate roll 5 solely via its point of support on the working roll 4. The risk of slip, in particular during the acceleration of the roll stand, is thereby considerably reduced.

I claim: Patent Claim

1. Four- or six-high roll stand having laterally supported working rolls (4), each support having a radially unmounted lateral intermediate roll (5) resting against the associated working roll (4), and two radially mounted supporting rollers (6, 8), characterized in that the support has a further lateral intermediate roll (7) and in that one lateral intermediate roll (5) is supported against one of the two supporting rollers (6) and the further lateral intermediate roll (7), which is supported against the other supporting roller (8) and, in the case of a four-high roll stand, against the supporting roll of the said supporting roller and, in the case of a six-high roll stand, against the intermediate roll (3) of the said supporting roller.

* * * * *